US006688538B2

(12) United States Patent
Nemoto et al.

(10) Patent No.: US 6,688,538 B2
(45) Date of Patent: Feb. 10, 2004

(54) IRRIGATION APPARATUS

(75) Inventors: Toshihisa Nemoto, Togane (JP); Terutaka Yasuda, Togane (JP)

(73) Assignee: Maruyama Mfg., Co., Inc., Tokyo (JP)

( * ) Notice: Subject to any disclaimer, the term of this patent is extended or adjusted under 35 U.S.C. 154(b) by 0 days.

(21) Appl. No.: 09/822,553

(22) Filed: Mar. 30, 2001

(65) Prior Publication Data

US 2002/0104896 A1 Aug. 8, 2002

(30) Foreign Application Priority Data

Feb. 6, 2001 (JP) ..... P2001-029893

(51) Int. Cl.[7] ..... A62C 15/00
(52) U.S. Cl. ..... 239/152; 222/175; 222/333
(58) Field of Search ..... 239/152; 222/175, 222/333, 527, 529

(56) References Cited

U.S. PATENT DOCUMENTS 2,932,127 A * 4/1960 Prance et al. ..... 144/208.92
2,958,155 A * 11/1960 Emmerich ..... 222/130
3,040,471 A * 6/1962 Blase ..... 222/175
3,421,697 A * 1/1969 Marks ..... 237/77
3,539,110 A * 11/1970 Kobayashi ..... 239/152
3,826,426 A * 7/1974 Bonvicini ..... 239/127
4,600,129 A * 7/1986 Kondo ..... 222/175
4,658,778 A * 4/1987 Gamoh et al. ..... 123/195 C
5,322,191 A * 6/1994 Johnson et al. ..... 222/79
5,752,661 A * 5/1998 Lewis ..... 222/175
6,113,004 A * 9/2000 Steingass et al. ..... 169/30

* cited by examiner

*Primary Examiner*—Christopher Kim
(74) *Attorney, Agent, or Firm*—Rosenthal & Osha L.L.P.

(57) ABSTRACT

A backpack type irrigation apparatus having a backpack frame, a pump attached to the frame, an internal combustion engine serving as a driving source for the pump, and a discharge hose connected to a discharge port of the pump. A throttle lever of the internal combustion engine may be attached to the backpack frame. With this arrangement, the pump and the engine can be moved together with the discharge hose, and also a suction hose can be moved. Accordingly, the water-supply range is enlarged. Also, the discharge amount can be adjusted by operating the throttle lever while driving the pump.

1 Claim, 3 Drawing Sheets

IRRIGATION APPARATUS

BACKGROUND OF THE INVENTION

1. Field of the Invention

The present invention relates to an irrigation apparatus for supplying water to the farmland or farm products, e.g., rice plants, tea plants, fruit trees, and the like cultivated there.

2. Related Background Art

A conventional irrigation apparatus is of the so-called stationary type. As shown in FIG. 1, this type of the irrigation apparatus 1 includes a suction hose 2 a suction end 3 of which is immersed in a water source 4 such as a reservoir or water tank, and a pump 5 positioned at an appropriate position within the reach of the other end of the water suction hose 2. The pump 5 is driven by an internal combustion engine 6 to pump up water. The water is supplied to the farmland or the like through a discharge hose 7.

Since the conventional irrigation apparatus 1 as described above is of the stationary type, it is general usage that the suction end 3 of the suction hose 2 is fixed. In this case, the moving range of a discharge end 8 of the discharge hose 7 is limited within a range (see the dashed line in FIG. 1) of a radius corresponding to the sum length of the water suction hose 2 and discharge hose 7. In addition, not only the suction end 3 of the suction hose 2 but also the pump 5 and internal combustion engine 6 are actually fixed at predetermined portions, so the moving range of the discharge end 8 of the discharge hose 7 is a very narrow range surrounded by the chain line in FIG. 1.

In the conventional irrigation apparatus 1, the discharge amount can be adjusted by controlling the rotational speed of the pump 5, i.e., the rotational speed of the internal combustion engine 6. The rotational speed of the engine 6 can be controlled by adjusting the opening of a throttle valve with a throttle lever 9. Since the throttle lever 9 is disposed in the vicinity of the engine 6 or the pump 5, it is difficult for an operator holding the distal end of the discharge hose 7 away from the pump 5 and internal combustion engine 6 to operate the throttle lever 9 during irrigation operation. In particular, in the stationary type irrigation apparatus 1, the discharge hose 7 tends to be formed long in order to reduce the problem of the narrow water supply range as described above, and accordingly it is very difficult to control the discharge amount during irrigation operation.

Accordingly, it is an object of the present invention to provide an irrigation apparatus with a wider water-supply range.

Also, it is another object of the present invention to provide an irrigation apparatus which can easily control the discharge amount during operation.

SUMMARY OF THE INVENTION

In order to achieve the above objects, an irrigation apparatus according to the present invention is characterized by comprising a backpack frame, a pump attached to the backpack frame, a driving source attached to the backpack frame and adapted to drive the pump, and a discharge hose connected to a discharge port of the pump.

With this arrangement, the operator can carry the pump and the driving source on his or her back with the backpack frame, and can move the pump and the driving source together with the discharge hose. Therefore, the reach of a suction hose connected to a suction port of the pump substantially coincides with the moving range of a discharge end of the discharge hose. In addition, as the pump and the driving source are movable, a suction end of the suction hose can be moved.

With the above arrangement, since the portion of the discharge hose to be held by operator's hand and the driving source or the pump are very close to each other, if the driving source is, e.g., an internal combustion engine, a throttle lever for adjusting the opening degree of the throttle valve of the internal combustion engine may be attached to the carrier frame, so that the throttle lever can be easily adjusted and accordingly the discharge amount can be controlled while discharging water from the discharge hose.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DESCRIPTION OF THE PREFERRED EMBODIMENTS

Figure 2:
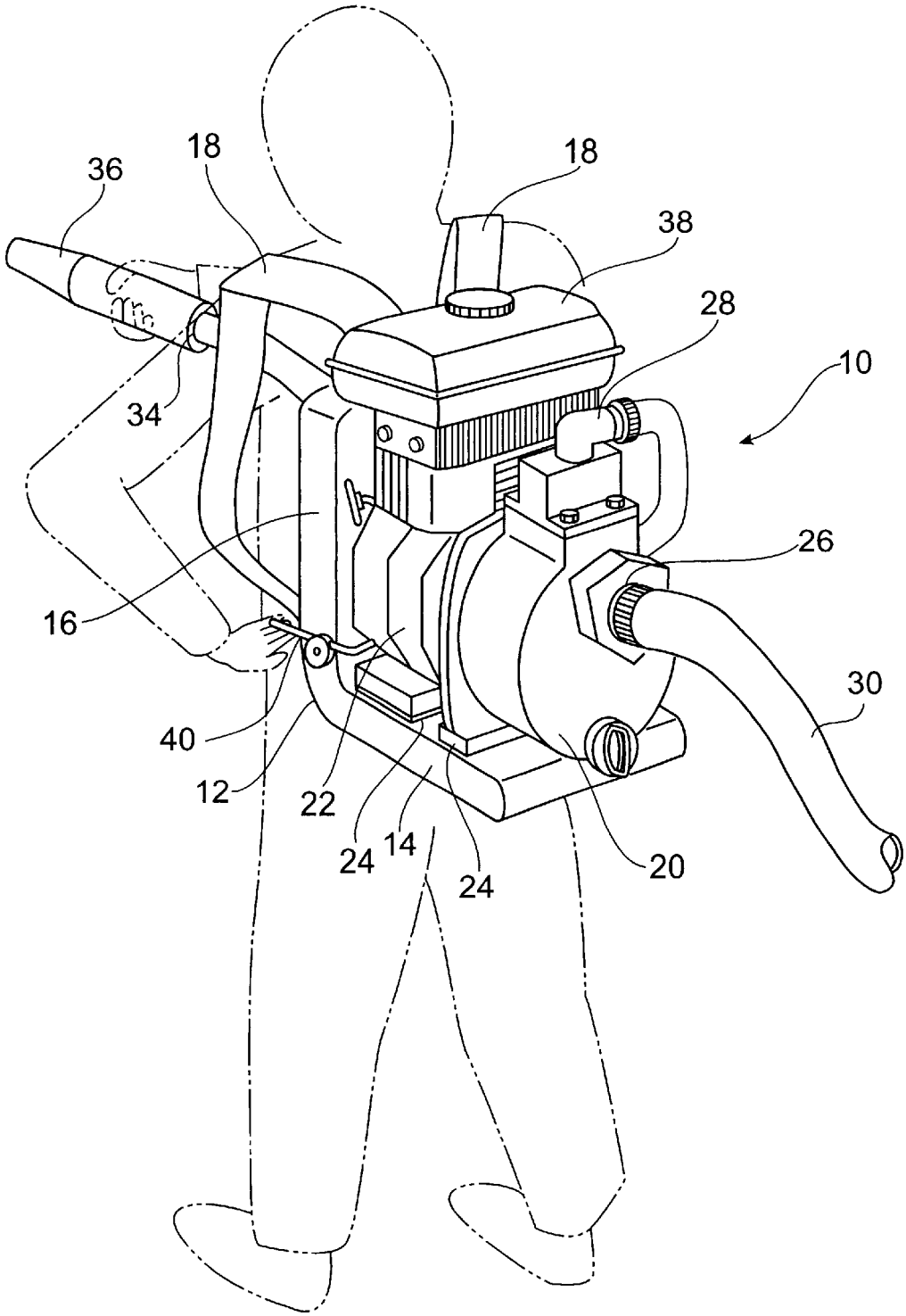
FIG. 2 is a perspective view of an irrigation apparatus according to the present invention, showing how to use the irrigation apparatus.

FIG. 2 is a perspective view showing an irrigation apparatus 10 according to the present invention. As shown in FIG. 2, the irrigation apparatus 10 is of the backpack type, and has a backpack frame 12 to be carried on by the back of an operator or user. The backpack frame 12 is formed of an L-shaped frame having a horizontal portion 14 and an upright portion 16 extending upright substantially at a right angle from one end of the horizontal portion 14. Shoulder straps 18 are attached to the upright portion 16 so the operator can carry the backpack frame 12 on his or her back.

A pump 20 and an internal combustion engine 22 are fixed to the horizontal portion 14 of the backpack frame 12, preferably by way of an anti-vibration member 24 such as a rubber mount.

A centrifugal pump such as a volute pump is suitable as the pump 20. The pump 20 has a suction port 26 and a discharge port 28 provided in its side surface and upper portion, respectively. The suction port 26 is connected to a suction hose 30. The discharge port 28 is connected to a discharge hose 32. When necessary, a discharge end 34 of the discharge hose 32 may be connected to a nozzle 36 suitable for the application. Generally, the operator is supposed to work while holding the distal end of the discharge hose 32 or the nozzle 36 with his right hand. As shown in FIG. 2, the discharge hose 32 is disposed to extend under the operator's right arm when the operator carries the backpack frame 12 on his or her back, and it has an appropriate length considering the ease in handling.

The internal combustion engine 22 serves as the driving source for the pump 20, and although not shown, its output shaft is directly coupled to the impeller of the pump 20. The engine 22 is preferably a lightweight and compact one. In particular, a two-cycle internal combustion engine is effective as the engine 22.

Referring to FIG. 2, reference numeral 38 designates a fuel tank for storing fuel necessary for driving the internal combustion engine 22. In the shown embodiment, the fuel tank 38 is fixed to the upper portion of the internal combustion engine 22. Alternatively, the fuel tank 38 may be fixed to the backpack frame 12 under the internal combustion engine 22.

A throttle lever 40 is attached to the lower side edge of the upright portion 16 of the backpack frame 12 in order to adjust the opening degree of the throttle valve (not shown) of the internal combustion engine 22, thereby controlling the rotational speed of the output shaft of the internal combustion engine 22 and accordingly the discharge amount of the pump 20. As described above, the operator usually handles the discharge hose 32 with his right hand. Thus, the throttle lever 40 is preferably attached to the left side of the upright portion 16 such that the operator can operate it with his or her left hand.

Figure 3:
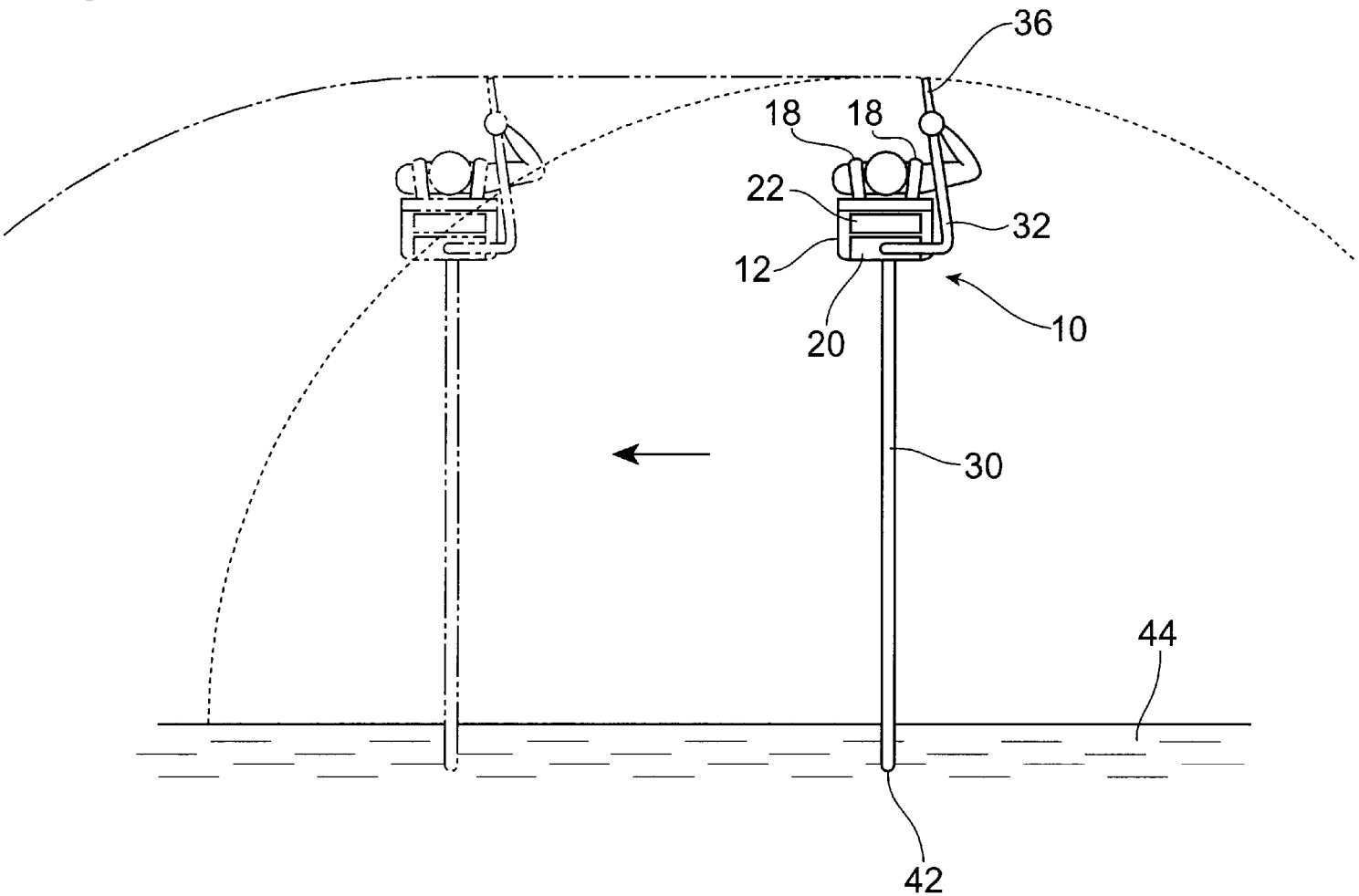
FIG. 3 is a view schematically showing the water-supply range of the irrigation apparatus according to the present invention.

To use the irrigation apparatus 10 with the above arrangement, one end of the suction hose 30 is connected to the suction port 26 of the pump 20, the other end or suction end 42 of the suction hose 30 is put in a water source 44 such as a reservoir or water tank, as shown in FIG. 3, and the operator carries the backpack frame 12 on his or her back. When the internal combustion engine 22 is actuated to drive the pump 20, water is pumped up from the water source 44, and is discharged from the nozzle 36 through the pump 20 and discharge hose 32.

Figure 1:
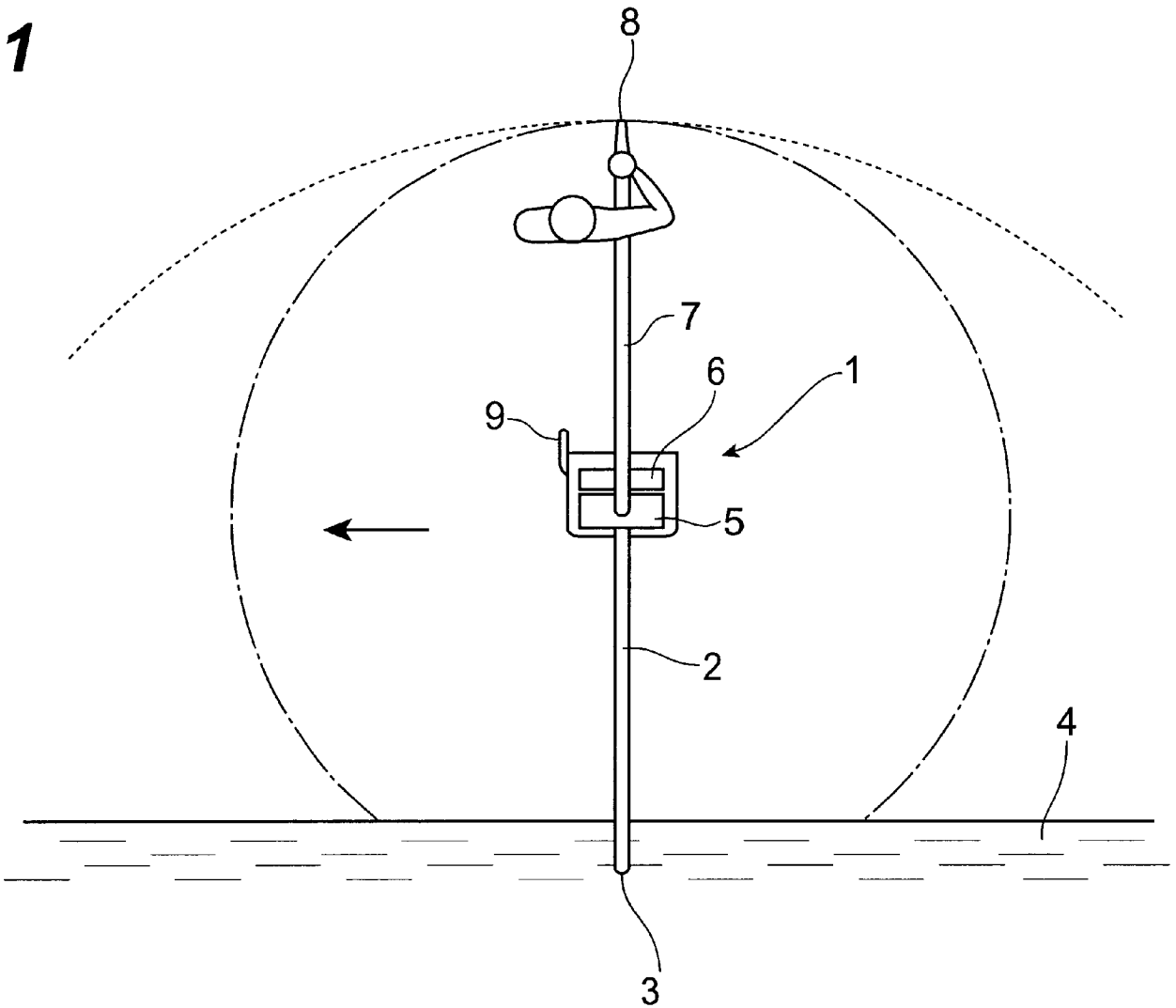
FIG. 1 is a view schematically showing the water-supply range of a conventional stationary type irrigation apparatus.

If the suction end 42 of the suction hose 30 is fixed, the nozzle 36 of the discharge hose 32 can be moved within a semicircle range having a radius almost coinciding with the length of the water suction hose 30, as indicated by the dashed line in FIG. 3. In the conventional stationary type irrigation apparatus, the apparatus itself is fixed at a predetermined portion and the moving range of the discharge end or nozzle of the discharge hose is actually restricted by the length of the discharge hose. Thus, provided that the sum length of the suction hose 30 and the discharge hose 32 is equal to that of the apparatus 1 shown in FIG. 1, the moving range of the nozzle 36, i.e., the water-supply range, is larger in the carrying type irrigation apparatus 10 according to the present invention than in the stationary type irrigation apparatus 1, as is apparent from a comparison of FIGS. 1 and 3.

As indicated by the two-dot chain line in FIG. 3, the irrigation apparatus 10 can be moved while being carried on the operator's back. Thus, the suction end 42 of the suction hose 30 immersed in the water source 44 can be moved during the driving operation of the pump 20. This can further widen the water-supply range.

Typically, the operator works by holding the distal end of the discharge hose 32 or the nozzle 36 with his or her right hand to adjust the water discharge direction. At this time, the operator can control the throttle lever 40 with his or her left hand. Therefore, the operator can adjust the discharge amount by controlling the throttle lever 40 while driving the pump 20, so a discharge amount suitable for the working condition can be obtained during irrigation operation.

Although an internal combustion engine 22 is used as the driving source for the pump 20 in the above embodiment, an electric motor may be used in place of the internal combustion engine 22. Particularly, in recent years, a small-power, high-output electric motor has been developed. If such an electric motor is used, a battery is also preferably mounted on the backpack frame 12 as a power supply. Also, when an electric motor is used, it is effective to place a volume for rotational speed adjustment (discharge amount adjustment) at a position where the throttle lever 40 is attached.

As has been described above, in the irrigation apparatus according to the present invention, the pump and the driving source for it can be carried on the operator's back and moved together with a discharge hose. Water can thus be supplied freely at least within the reach of a water suction hose connected to the pump. As the irrigation apparatus is movable, the suction end of the suction hose can be moved easily. Therefore, the water-supply range of the irrigation apparatus of the present invention increases greatly, as compared to that of the conventional stationary type apparatus, even though the suction hose is fixed. In addition, since the irrigation apparatus of the present invention can be moved even while the pump is driven, the operation efficiency increases.

Furthermore, if the driving source is an internal combustion engine, its throttle lever is attached to the backpack frame. Then, the operator can hold the discharge hose with his or her one hand and operate the throttle lever with the other hand to control the discharge amount. Therefore, the operator can work with an appropriate discharge amount without interrupting irrigation operation.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An irrigator, comprising:

a remote water source; and an irrigation apparatus, comprising:

a backpack frame;

a pump attached to said backpack frame said pump having a discharge port for discharging water therefrom and a suction port for sucking water from the remote water source;

a driving source attached to said backpack frame and adapted to drive said pump, wherein said driving source is an internal combustion engine which has a throttle valve provided therein;

a throttle lever attached to said backpack frame and adapted to adjust an opening degree of said throttle valve;

a discharge hose connected to said discharge port of said pump for discharging water; and a suction hose connected to said suction port for sucking water from the remote water source, a suction end of said suction hose freely extendable outward to be immersed into the remote water source;

wherein an operator can freely carry the irrigation apparatus to a position where water needs to be discharged within a reach of the suction hose while having the suction end of the suction hose immersed in the remote water source, and control an amount of water discharged at that position by adjusting the driving source via the throttle lever without discontinuing irrigation operation, and wherein the remote water source is detached from the irrigation apparatus.

* * * * *